US005457920A

United States Patent [19]

Waltz

[11] Patent Number: 5,457,920

[45] Date of Patent: Oct. 17, 1995

[54] RIDGE TOP VENT FOR ROOFS

[75] Inventor: David A. Waltz, Vancouver, Wash.

[73] Assignee: Vent Air Inc., Vancouver, Wash.

[21] Appl. No.: 166,302

[22] Filed: Dec. 13, 1993

[51] Int. Cl.[6] ..... E04D 13/17

[52] U.S. Cl. ..... 52/199; 52/198; 454/367; 454/365

[58] Field of Search ..... 52/199, 198, 57, 52/43, 71, 302.1; 454/364–367

[56] References Cited

U.S. PATENT DOCUMENTS

| | | | |
|---|---|---|---|
| 1,785,682 | 12/1930 | Hamilton . | |
| 1,896,656 | 2/1933 | Anderson . | |
| 3,236,170 | 2/1966 | Meyer et al. . | |
| 3,481,263 | 12/1969 | Belden | 52/57 X |
| 3,660,955 | 5/1972 | Simon . | |
| 4,280,399 | 7/1981 | Cunning . | |
| 4,325,290 | 4/1982 | Wolfert . | |
| 4,545,291 | 10/1985 | Kutsch et al. . | |
| 4,642,958 | 2/1987 | Pewitt . | |
| 4,643,080 | 2/1987 | Trostle et al. . | |
| 4,803,813 | 2/1989 | Fiterman | 52/199 |
| 4,817,506 | 4/1989 | Cashman . | |
| 4,924,761 | 5/1990 | MacLeod et al. . | |
| 5,094,041 | 3/1992 | Kasner et al. | 52/57 |
| 5,304,095 | 4/1994 | Morris | 454/365 |
| 5,331,783 | 7/1994 | Kasner et al. | 52/199 |

FOREIGN PATENT DOCUMENTS

| | | |
|---|---|---|
| 3320850A1 | 12/1984 | Germany . |
| 3615015C1 | 12/1987 | Germany . |

*Primary Examiner*—Carl D. Friedman
*Assistant Examiner*—Robert J. Canfield
*Attorney, Agent, or Firm*—R. Reams Goodloe, Jr.

[57] ABSTRACT

A ridge type roof vent. A roof vent is provided for use on a ridge of a roof. The vent has grillee portions flexibly located longitudinally along the lateral edges. The grille portions have at their distal end a set of flexible teeth adapted to fit on shingles and down between shingles in the gaps therebetween, so as to prevent passage between the grille and the shingle of any debris, insects, or vermin. The grille portions have void defining structures therein adapted to receive therethrough a nail guide and support, which guide is suitable for locating a nail to affix the vent to a roof. The vent is manufactured in a flat configuration, and thus it is capable of being easily packed and shipped. When folded at the hinged bends by the installer, the vent provides full venting capability while protecting against passage therethrough of unwanted debris, insects, or vermin.

21 Claims, 11 Drawing Sheets

RIDGE TOP VENT FOR ROOFS

TECHNICAL FIELD OF THE INVENTION

This invention relates to roof vents, and more particularly to a novel roof vent designed for placement on the ridge of a roof to allow ventilation of the attic space below the roof.

BACKGROUND OF THE INVENTION

A variety of designs exist for roof vents. Recently, the use of a "ridge type" vent has become popular. That type of design reduces the number of roof penetrations necessary to achieve adequate venting. Also, it allows placement of the vent at the upper reaches of the attic space, thus enhancing the exit of any warmed air which may tend to accumulate in the attic space below the roof.

Unfortunately, many of the vent designs currently available for such ridge type service are unduly complex to manufacture. Further, many of the heretofore available designs known to us take up an undesirable volume for shipment. Many of the ridge type vent designs currently available do not provide what I consider to be an adequate system of barriers against windblown debris, insects, or vermin. Therefore, a continuing demand exists for a simple, and inexpensive ridge type roof vent. More particularly, there exists a demand for a ridge type roof vent which has reduced shipping volume, and which provides a good barrier for protection against debris, insects, and vermin. Moreover, significant improvements can still be made in the design of a ridge type vent that can be inexpensively produced, easily stored and shipped, which provides a good debris barrier, and which can be installed with minimal training and expense by unskilled or semi-skilled workmen.

Many roof vents of the character described above which provide the general capabilities desired have heretofore been proposed. Those of which I am aware are disclosed in U.S. Pat. Nos.: 4,924,761, issued May 15, 1990 to MacLeod et al. for ROOF VENT; 4,817,506, issued Apr. 4, 1989 to Cashmann for ROOF VENT; 4,643,080 issued Feb. 17, 1987 to Trostle et al. for ROOF RIDGE VENTILATOR SYSTEM; 4,642,958 issued Feb. 17, 1987 to Pewitt for VENTILATED WALL AND ROOFING SYSTEM; 4,545,291, issued Oct. 8, 1985 to Kutsch et al. for ROOFLINE VENTILATORS; 4,325,290 issued Apr. 20, 1982 to Wolfert for FILTERED ROOF RIDGE VENTILATOR; 4,280,399 issued Jul. 28, 1981 to Cunning for ROOF RIDGE VENTILATOR; 3,660,955 issued May 9, 1972 to Simon for STRUCTURE FOR PROVIDING AIR CIRCULATION AT THE ROOF OF A BUILDING; 3,236,170 issued Feb. 22, 1966 to Meyer et al. for VENTILATED ROOF CONSTRUCTION; 1,896,656 issued Feb. 7, 1933 to Anderson for ASSEMBLY OF METAL SURFACES; 1,785,682 issued Oct. 22, 1928 to Hamiliton for WINDOW VENTILATOR; West German Patent No. 3,320,850 issued December 1984 to CPMC; and West German Patent No. 36 15 015.0-25 issued December 1987 to Knoche.

For the most part, the documents identified in the preceding paragraphs disclose devices which have one or more of the following shortcomings: (a) they are difficult or bulky to package, (b) their design is more complicated than is desirable, and as a result, (c) they are relatively expensive to manufacture.

One of the most common deficiencies of the heretofore available roof vent designs of which I am aware, the relative complexity of the design, is primarily due to the type of airflow structure provided. Also, some designs, such as that shown in the MacLeod patent, require the insert of some barrier material to restrict the entry of insects and vermin. Such a barrier reduces venting efficiency and is also subject to becoming clogged or plugged over the life of the device, thus leading to reduced efficiency. Also, some prior art roof vents have gutter like projections from beneath the shingles which detracts from the visual appearance of the vent, as well as accumulates unwanted debris. Thus, the advantages of the compact, arched and visually pleasing, straight through airflow grille design of our easily manufactured roof vent are important and self-evident.

SUMMARY OF THE INVENTION

I have now invented, and disclose herein, a novel, improved roof vent which does not have the above-discussed drawbacks common to those somewhat similar products heretofore used of which I am aware. Unlike the roof vents heretofore available, our product is simple, lightweight, relatively inexpensive and easy to manufacture, and otherwise superior to those heretofore used or proposed. In addition, it provides a significant, demonstrated additional measure of additional protection against entry of unwanted debris, insects, and vermin when compared to many currently known designs.

I have developed a novel roof vent for use on a ridge of a roof. The vent has a body portion with an upper wall portion and sidewalls at the ends thereof. Grille portions are hingedly located longitudinally along the lateral edges. Wedge shaped stiffening supports are provided above the grille to keep the grille from compressing upward against the underside wall of the roof vent. Likewise, in the preferred configuration, generally triangular shaped support wings are provided below the grille to prevent the grille from compressing downward against the roof. The grille is folded under the upper wall portion, so that the stiffening supports act as spacers between the underside wall of the vent and the grille, when the grille is placed into the operating position. The grille portions have at their distal end a set of flexible teeth adapted to fit on shingles and down between shingles in any gap therebetween, so as to prevent passage between the grille and the shingle of any debris, insects, or vermin. The grille portions have void defining structures therein adapted to receive therethrough a nail guide and support, which guide is suitable for locating a nail to affix the vent to a roof. The vent is manufactured in a flat configuration, and thus it is capable of being easily packed and shipped. When folded at the hinged bends for installation, the vent provides full venting capability while protecting against passage therethrough of unwanted debris, insects, or vermin.

OBJECTS, ADVANTAGES, AND FEATURES OF THE INVENTION

From the foregoing, it will be apparent to the reader that one important and primary object of the present invention resides in the provision of a novel, improved roof vent to provide ease of manufacture, shipping, storage, and installation.

Other important but more specific objects of the invention reside in the provision of roof vent as described herein which:

can be manufactured in a simple, straightforward manner;

in conjunction with the preceding object, have the advantage that they can be configured by installation personnel to quickly establish an operating vent position; and which provides a vent which is fully protective from windblown debris, insects, and vermin; and which are designed so as to prevent compression of the vent downward against a roof; and which provide a means for safely and reliably coupling a series of vents to provide a roof wide vent while allowing for expansion and contraction of the vents.

Other important objects, features, and additional advantages of our invention will become apparent to the reader from the foregoing and the appended claims and as the ensuing detailed description and discussion proceeds in conjunction with the accompanying drawing.

DETAILED DESCRIPTION OF THE INVENTION

Figure 1:
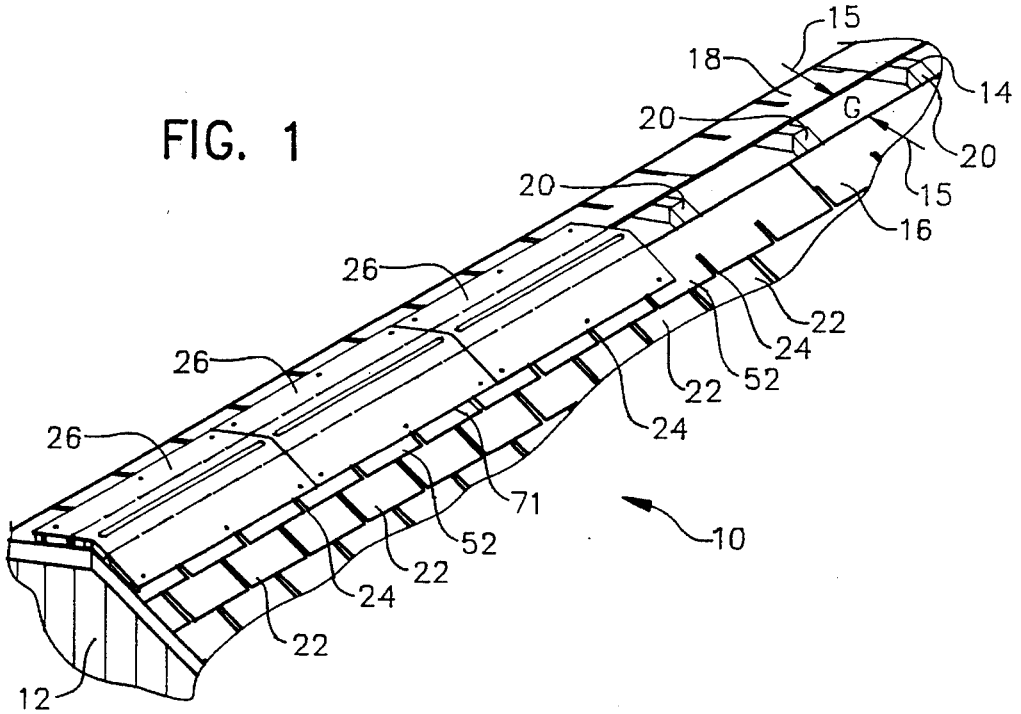
FIG. 1 is a perspective view of a roof ridge whereupon three roof vent panels according to the present invention are provided; a section of roof which has been prepared for receiving additional roof vent panels is also illustrated.

Attention is directed to FIG. 1, where there is shown a roof portion 10 of a building 12. The roof portion 10 has a ridge section 14 where a gap G indicated by arrows 15 exists between a first roof section 16 and a second roof section 18. Seen in the gap G are roof support trusses 20. The roof portion 10 is shown having a decking (see FIG. 2 below) covered with shingles 22. The shingles 22 may be of the kind having locating slots 24 therein. A series of roof vents 26 are provided above the gap G at ridge section 14; the vents 26 are configured to span the gap G between the first roof section 16 and the second roof section 18.

Figure 2:
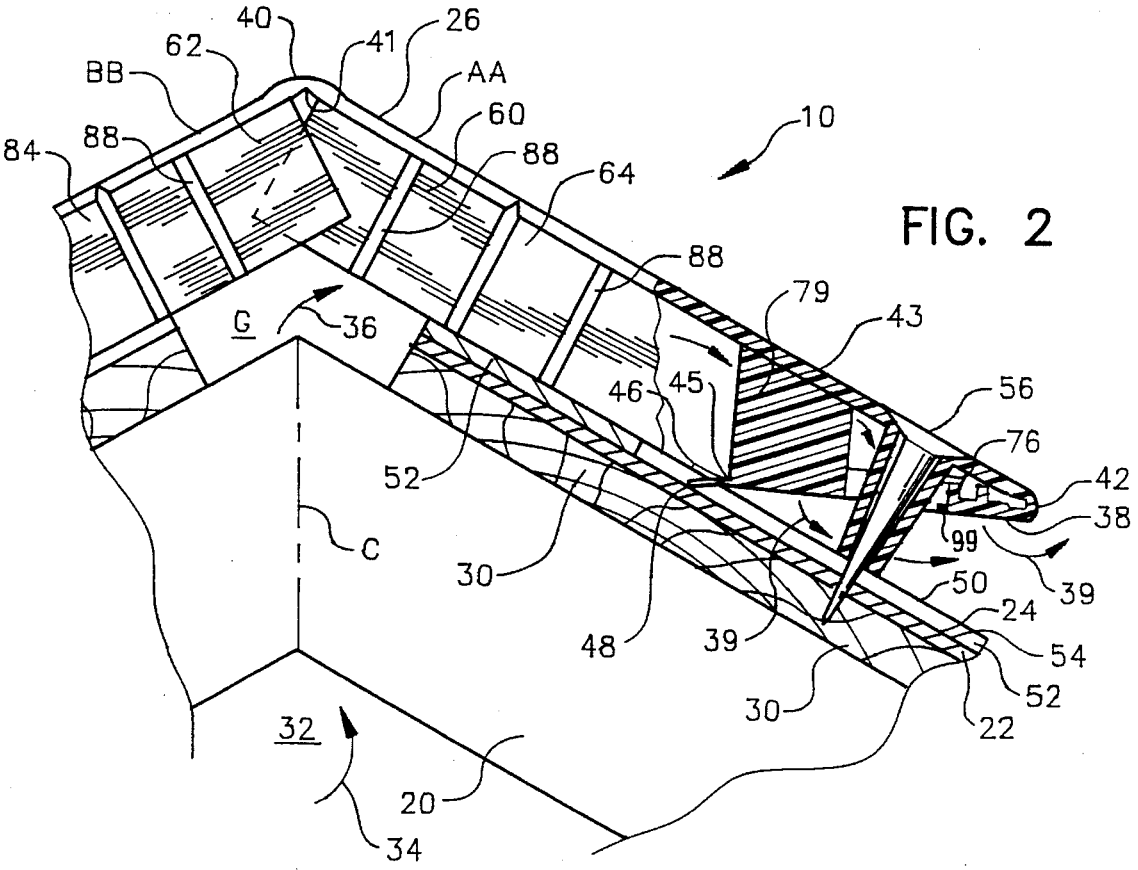
FIG. 2 is a cross-sectional view of a roof vent in place on a roof, taken as if across line 2—2 of FIG. 6 below (note change in location at partial cutout); this view reveals the grille and vanes which allow air to vent from the attic space below the roof, and also the overlapping sidewalls which serve to stiffen and support the vent, as well as providing protection at the end panels against unwanted entry of debris, insects, and vermin.

As can be more readily seen in FIG. 2, roof portion 10 has a roof deck 30 (generally particle board or plywood), which is supported by trusses 20. Shingles 22 are provided above deck 30, usually in interlocking fashion as illustrated in FIGS. 1 and 2, if composition type shingles are utilized. Below the roof deck 30 is a space 32, normally enclosed so as to form an attic or ventilation space. It is usually necessary and desirable to remove air from space 32 to provide proper ventilation, so as to effect heat reduction in summer and moisture removal in winter. This is accomplished by allowing the hot or moisture laden air in space 32 to move upward in the direction of arrow 34 through gap G. Then, the air turns outward as indicated by arrow 36, thence down through grille 38 and outward to the atmosphere as indicated by arrows 39. The grille 38 is adapted to prevent the passage of solids above a preselected critical size from passage therethrough.

FIG. 2 is a vertical cross-sectional view, taken along the line 2—2 of FIG. 6 below, and including an offset for the area shown in cutout in this FIG. 2. In FIG. 2, roof vent 26 is shown in its installed position above gap G of roof 10. Vent 26 is provided with a reinforcing portion 40 running longitudinally along the upper side of vent 26. The reinforcing portion 40 overlays the related cutout portion 41 also running longitudinally along the underside of vent 26 (see FIG. 3 for further detail). The cutout portion 41 provides a reduced thickness at the joint between the first and second inner integral planar body portions (AA and BB respectively) on either side of the vent 26, so that panels AA and BB can easily bend downward laterally along cutout portion 41.

Flexible bend or hinge 42 is provided between a first outer planar body portion 43 of vent 26 and the grille 38. This bend 42 is preferably provided in sufficient thickness so that it tends to urge the grille 38 downward toward shingles 22. The distal end 45 of the grille 38 has molded therewith and extending therefrom teeth 46 and 48 which either are compressed upward (teeth 46) against the upper shingle 52 at its upper surface 50, or are extended (teeth 48) into gap 24 and thence downward against the lower shingle 22 at the upper surface 54 thereof. On the laterally opposing side of vent 26, a second outer planar body portion 55 is similarly provided; it connects laterally inward with panel BB and outwardly with a similar grille, as seen for example in FIGS. 3 or 6 below.

Vent 26 is secured against roof 10 by way of nails 56 which are driven into roof deck 30.

It can be seen that vent 26 is provided with interfitting sidewall portions 60 and 62, which come together below the bend at the center reinforcing portion 40 and cutout portion 41, so as to minimize the formation of any gap between sidewalls 60 and 62. Extending outwardly laterally along the male end M of the roof vent 26, additional sidewall portions 64 provide both end barriers and support for the vent 26. These sidewall portions 60, 62, 64, provide adequate vertical spacing of the vent 26 above the upper surface 50 of shingle 52. Also, the sidewall portions 64 provide extra strength in the case that additional shingles, similar to those identified as 22 and 52, are affixed above vent 26 by nailing therethrough. Similar sidewall support portions are provided on the female end F of vent 26, as shown in FIG. 6 below.

Figure 3:
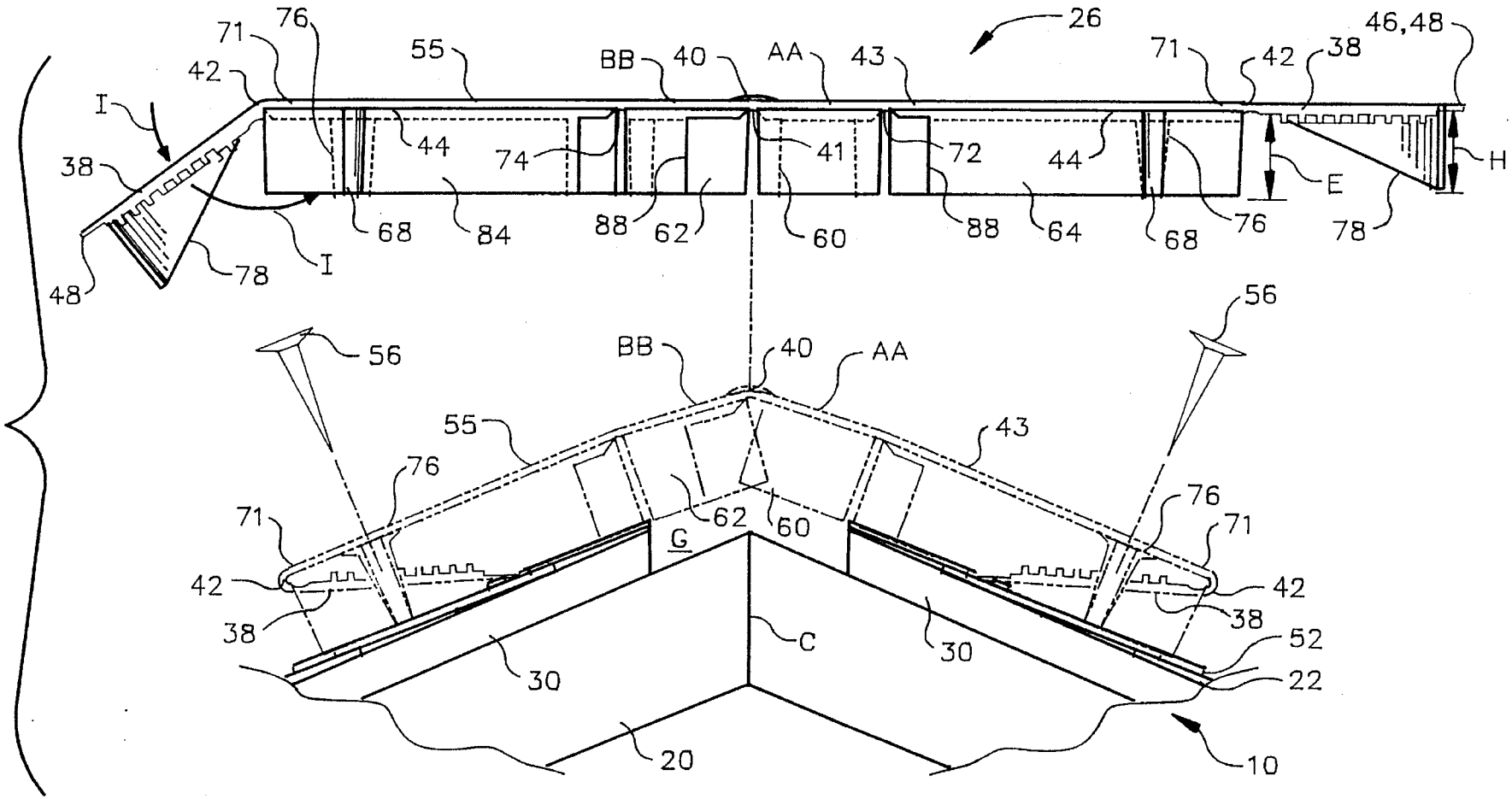
FIG. 3 is an end view of a roof vent, illustrating the folding action of the grille portions, and the stiffening supports adjacent thereto, as well as the end panels and nail guide supports; the roof vent is shown in solid lines before installation, and is shown below in hidden lines after placement on a roof.

Turning now to FIG. 3, a side view of the roof vent 26 is provided to show "before" and "after" configurations during preparation for installation. At the top of FIG. 3, a vent 26 is shown in a flat configuration, ready to bend into shape for affixing to the roof 10. Here, the male end M of the vent 26 is shown, and thus tabs 68 are seen extending from the male end M of the vent 26.

To place the vent 26 into an operating position, both grilles 38 are turned under the underside wall 44 of the vent 26 at hinges 42, which are located at the lateral edges 71 of the vent 26. For example, the first grille 38 at the left of FIG. 3 is shown being turned inward and upward in the direction of reference arrows I in a hinged fashion at hinge 42, so as to place the grille 38 into its operating position illustrated immediately below. Then, the vent 26 is bent inward and downward along reinforcing portion 40 and cutout portion 41 at the center of the vent 26, so that the opposing lateral edges 71 of vent 26 are turned inward and downward somewhat toward each other. Where necessary, additional inward bending can be accomplished at longitudinal cutout portions 72 and 74, located on opposing sides of the vent. The bend at the center along portions 40 and 41, as well as the adjacent bends along cutout portions 72 and 74, are particularly helpful in aligning the vent along the center C of the gap G along the roof 10 ridge.

Sidewall supports 60, 62, 64 and 84, well as nail guides 76, support the vent 26 above shingles 22 and 52, thereby preventing the underside wall 44 of vent 26 from compressing downward against the shingles 22 and 52. An important feature of this roof vent 26 are the wedge shaped stiffening supports 78, which are provided in sets located transversely in a spaced apart relationship along grille portions 38. This feature is continued at nail guides 76 by use of shortened companion support posts 79, which are located adjacent to nail guides 76. The stiffening supports 78 and support posts 79 provide the necessary strength uniformly to support roof vent 26 above roof 10. Preferably, sidewall supports 60, 62, 64, and 84 are of a height E, and the wedge shaped supports 78 are of a height H, where H is slightly less than E (when both are measured to a common datum such as underside wall 44) such that when wedge shaped supports 78 are interposed below the underside wall 44 of vent 26, the wedge supports fit firmly between the wall 101 and the grille 38 therebelow, so as to provide a relatively uniform spacing for air passage through grille 38.

Figures 4, 5:
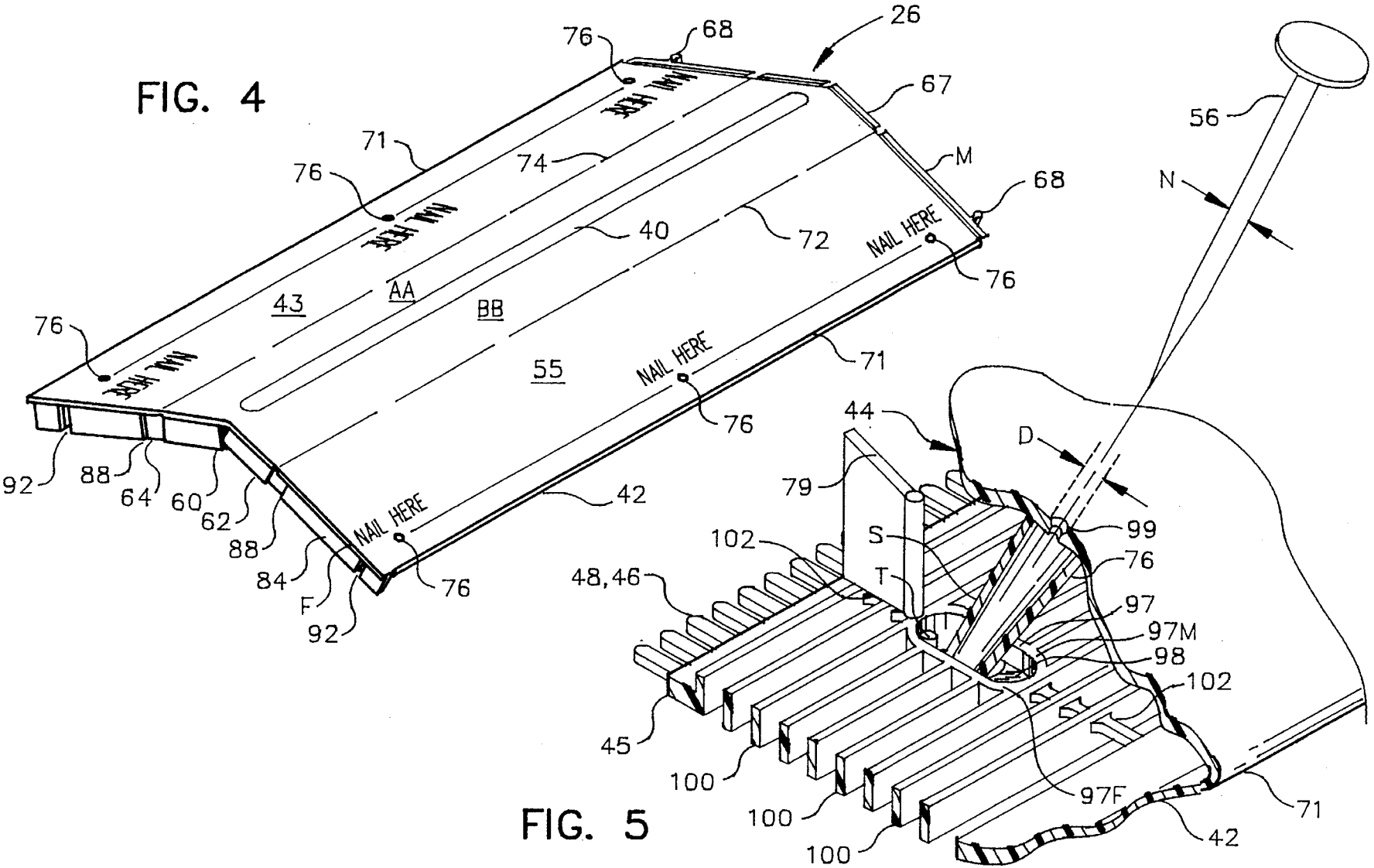
FIG. 4 is perspective view of a roof vent, showing the vent folded and bent into an operating position, ready for installation on a roof.
FIG. 5 is a partial cut-away view of the grille portion at the lateral edges of a roof vent, showing in cross-sectional view a nail guide support and a companion oval shaped structure in the grille which defines an opening through which the nail guide support penetrates the grille to reach the roof below; also shown are the flexible teeth at the inner edge of the grille which are adapted to engage roofing shingles which may be located therebelow.
Figure 6:
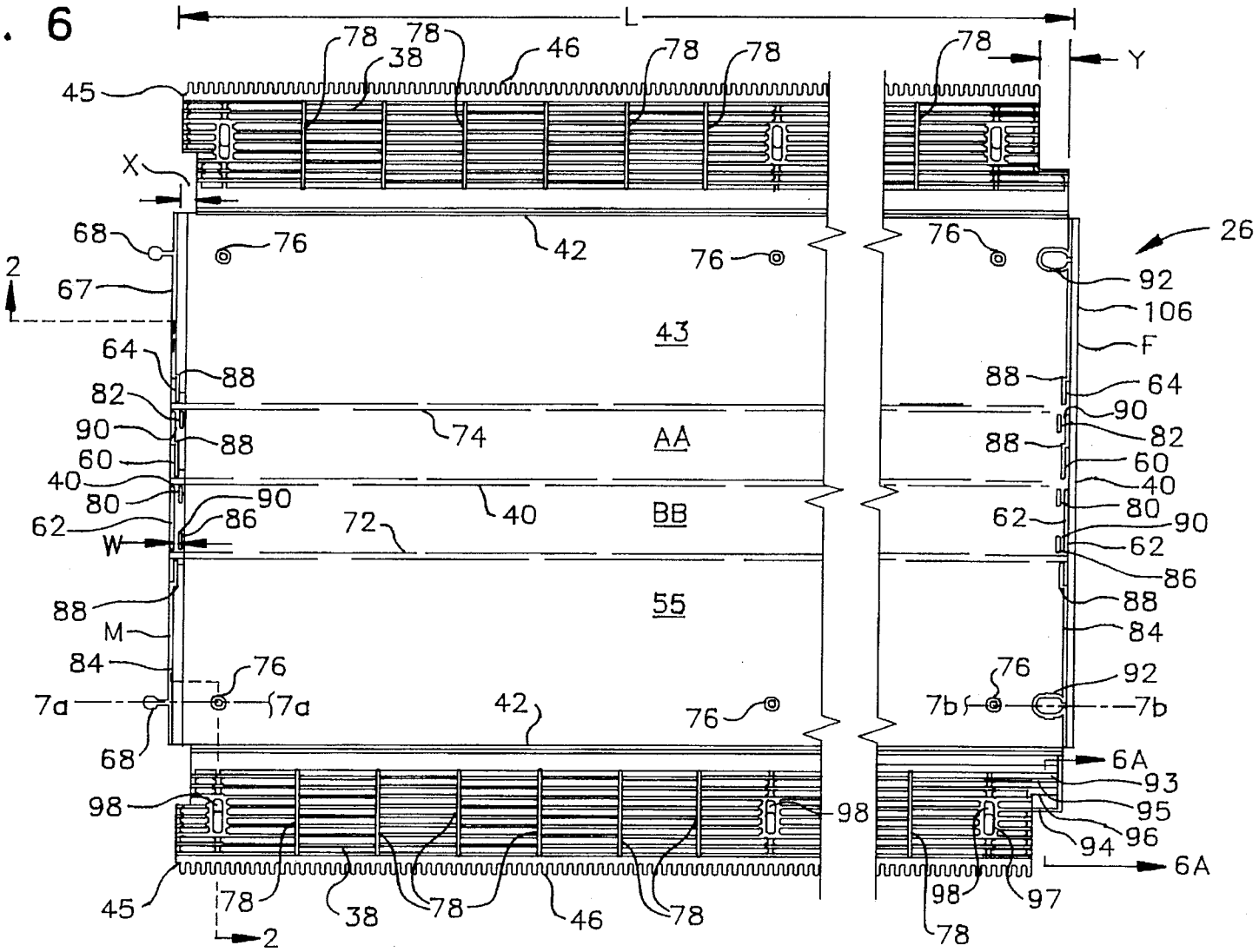
FIG. 6 is a bottom view (looking upward) of a first embodiment of a roof vent, showing the inner portions and the grille portions in a flat, spread apart relationship.

The offset between interfitting sidewall portions 62 and 60 may be better seen in FIG. 4 and 6. When the vent 26 is bent inward and downward toward in an installation configuration as is illustrated in FIG. 4, at the female end F, sidewall 60 fits between sidewall 62 and interior tab 80. Likewise, sidewall 64 fits between sidewall 60 and interior tab 82. Also, sidewall 84 fits between sidewall 62 and interior tab 86. To accomplish the described interfitting between sidewalls, an offset 88 is provided to realign a particular sidewall to the center line of a space 90 between an opposing sidewall and an interior tab. This space 90 should be provided in a width W to closely accommodate the width of the interfitting sidewall to be placed between the interior tab and the opposing sidewall, as just described above, without any substantial gap therebetween. For example the width W of space 90 between sidewall 60 and tab 82 is only slightly wider than the width (along longitudinal direction of vent 26) of the interfitting sidewall 64.

The vent 26 is provided in any convenient length L; for most U.S. construction sites, this length is four (4) feet, although lengths L of two (2) feet may be desirable in some cases. Grilles 38 are shortened for clearance around sidewalls 64 and 84 by a length X at the male end M of vent 26. Likewise, grilles 38 are shortened by a length Y around receptacles 92 at female end F of vent 26. I have found it convenient to use a length X of about ⅛ of an inch, and a length Y of about ⅝ of an inch.

Figure 6A:
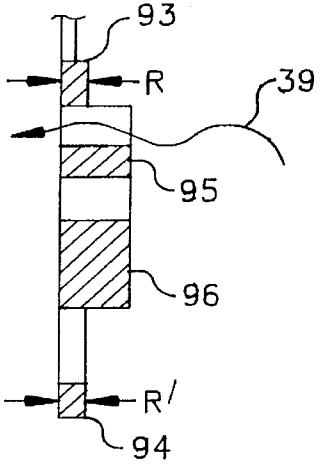
FIG. 6A is a cross sectional view taken across 6A—6A of FIG. 6, showing the height differential of various segments of the grille; this differential allows components of the grille to cooperate to with the tab receptable in order to provide adequate clearance with the tab receptacle when the vent is folded into its operating position.

As shown in FIG. 6A, it is important to note that at the female end F of vent 26, the grilles 38 have a reduced height R at grille portion 93 to allow the grille 38 to easily fold inwardly. More importantly, a reduced height R' is provided at the lateral edge of grille 38 with respect to grille portion 94, so that when the grille 38 is folded into the operating position, clearance is provided between grille portion 94 of grille 38 and receptacles 92. I find that a height of R and R' of about ⅛ inch or slightly less is desirable. Grille portions 95 and 96 are normally twice or slightly more of the thickness of the grille portions 93 and 94. I prefer to use this technique to allow the grille to be closely placed with recepticles 92, in order to avoid inteference of the receptacles with the folding and bending of the vent 26, and accompanying interfetting sidewalls described above.

Returning now to FIG. 5, a cutaway view of nail guide 76 is provided. The guide 76 is provided with sufficient structural strength to prevent compression of the grille downward thereabout when a nail is placed therethrough. To closely fit nail guide 76 through grille 38, the grille 38 accommodates nail guide 76 therethrough by way of void space defined by grille guide sidewalls 97, which may be convenient to provide in an oval shape. Fill-in plane 98 hels to snugly fit grille 38 against nail guide 76. This filled in surface 98 provides a partial seal between the longitudinal end portions $97_F$ and $97_M$ of the sidewalls 97, and inward up to the operating position of nail guide 76, so as to minimize the open space left behind upon installation of the vent 26. Fill-in plane 98 is ideally about as thick as grille portions 93 and 94. To help secure nail guide 76 during assembly, a tip T may be provided at the front of grille guide sidewall 97, to frictionally engage the downwardly extending generally tubular shaped wall S of nail guide 76 to prevent outward slippage of the grille portion 38.

The nail guide 76 may be provided with a small chamfered entry 99 for nail 56, when desirable. The entry 99 is preferably has a smaller diameter D than the diameter N of nail 56. As noted above, support post 79 is provided to properly space grille 38 above the underside wall 44 of vent 26, so as to keep roof vent 26 from collapsing inwardly.

The grille 38 also includes a series of substantially vertical vanes 100 running longitudinally along vent 26. The vanes 100 are spaced apart and strengthened by transverse running support segments 102. At the distal end 45 of grille 38, flexible tabs 48 are provided (also noted above as tabs 46 above when in a deformed position above a shingle 52).

Figure 7:
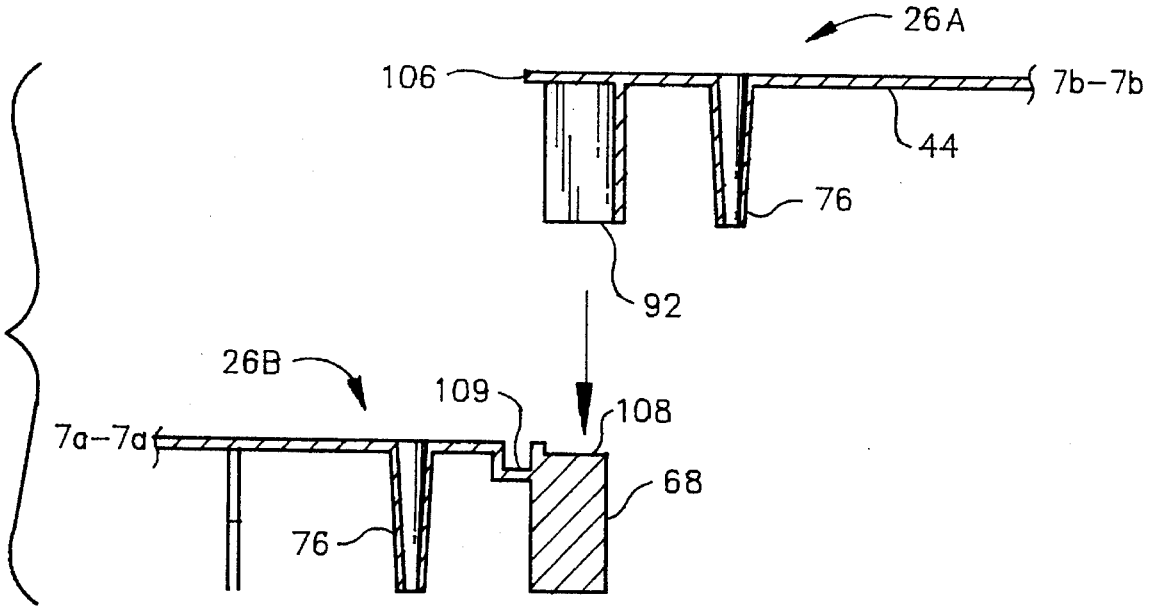
FIG. 7 is a view of opposite ends of two adjacent roof vents, taken as if through the lines *7a–7a* and *7b–7b* of FIG. 6, showing the method for joining adjacent roof vents during installation on a roof; here, the parts are shown before joining adjacent panels.
Figure 8:
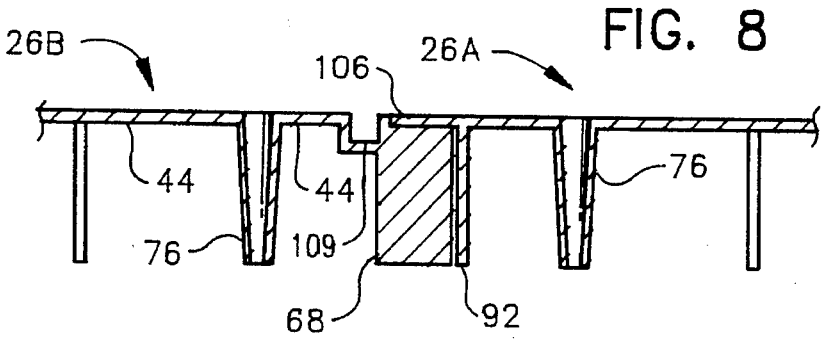
FIG. 8 is a view similar to FIG. 7 of two adjacent roof vents, again showing portions taken as if through the lines *7a—7a* and *7b—7b* of FIG. 6, but now showing the adjacent roof vents joined by interlocking parts.

Attention is now directed to FIGS. 7 and 8. In order to securely interlock a series of roof vents 26 located on a roof structure 10, tabs 68 are provided at male end M, sized for snugly inserting in receptacles 92 at female end F. As shown, the female end F of a first vent 26A fits down over male end M of a second vent 26B. Receptacle 92 fits around tab 68. The section shown for first vent 26A is as if taken through line *7b—7b* of FIG. 6. The section shown for second vent 26B is as if taken through line *7a—7a* of FIG. 6.

An overhanging edge 106 of vent 26A extends above the top 108 of tab 68 on vent 26B, and thus covers the male end M of vent 26B. The overhangings edge 106 causes the ends of the vents 26A and 26B to overlap, thereby forming a continuous ridge type vent along the roof ridge of a structure upon which it has been placed.

My interlocking roof vent feature is clearly seen in FIG. 8, where the vents 26A and 26B are shown joined together in their operative position. In particular, note the vertically offset (lowered) generally U-shaped gutter 109 which is provided between tab 68 and the top of vent 26B, which tends to prevent moisture from escaping through the joint between vents 26A and 26B toward the roof 10 below.

Figure 9:
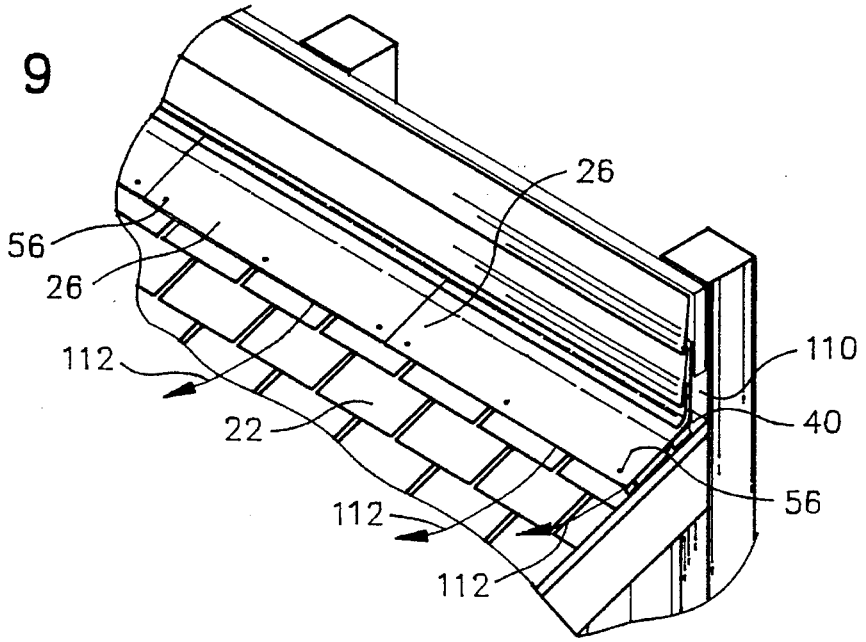
FIG. 9 is a perspective view of the roof vent of the present invention, now employed by bending the panels into a configuration for a clerestory installation.

FIG. 9 illustrates the alternative use of the vent 26 in clerestory applications. In such installations, vent 26 is bent backwards at reinforcing 40 and cutout portion 41, into a generally L-shaped configuration. In such configuration, the space 110 is vented outward in the direction of arrows 112.

Figure 10:
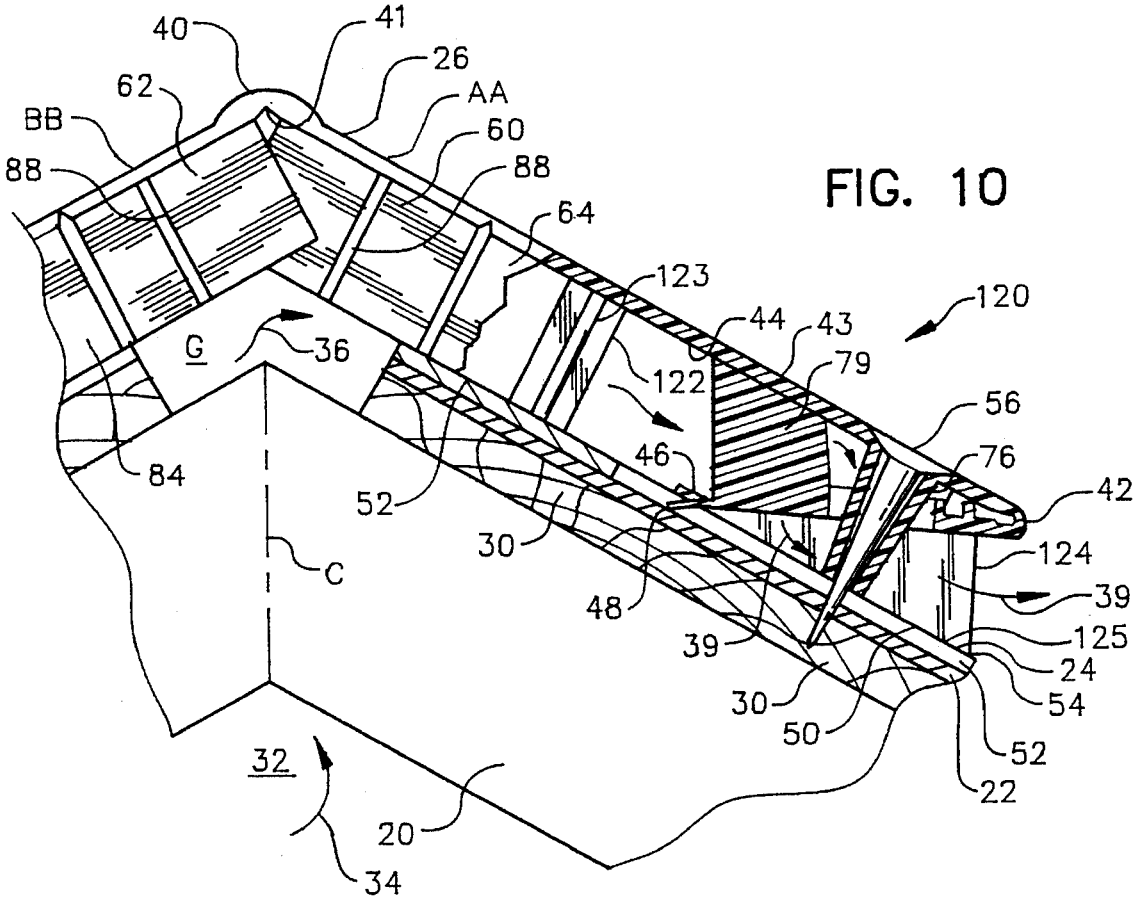
FIG. 10 is a cross-sectional view of a roof with roof vent in place; this view reveals the grille and vanes which allow air to vent from the attic space below the roof, and also the overlapping sidewalls which serve to stiffen and support the vent, as well as providing protection at the end panels against unwanted entry of debris, insects, and vermin.

Attention is now directed to FIG. 10, where a second embodiment of my novel ridge top vent for roofs is shown in a partial cross-sectional view. To the extent feasible, similar features will be identified by using the same reference numerals as already described hereinabove, without further mention thereof. In this FIG. 10, vent 120 is shown in place on a roof 10, similar to the configuration shown in FIG. 2 above. Here, additional support posts 122 are provided beneath underside wall 44. Posts 122 fit down to shingles 52, to support vent 120 to prevent it from sagging downward. For added strength, posts 122 may be provided with a thickened center portion 123.

In addition, support wings 124 are provided below grille 38. For best support, support wings 124 are preferably provided in a generally triangular shape extending vertically downward below grille 38 and inward toward the centerline of the roof. The support wings 124 achieve maximum effect when a foot 125 is provided in a shape adapted to extend laterally along the roof and fit the contour of shingles 54. Preferably, support wings 124 are integrally molded to the grille portion 38. More preferably, the support wings 124 are lower extensions of the earlier noted internal stiffening supports 78. Support wings 124, in cooperation with the stiffening supports 78 (see FIG. 13 below) securely position grille 38 between the roof shingles 52 and the underside wall 44 of vent 120.

Figure 11:
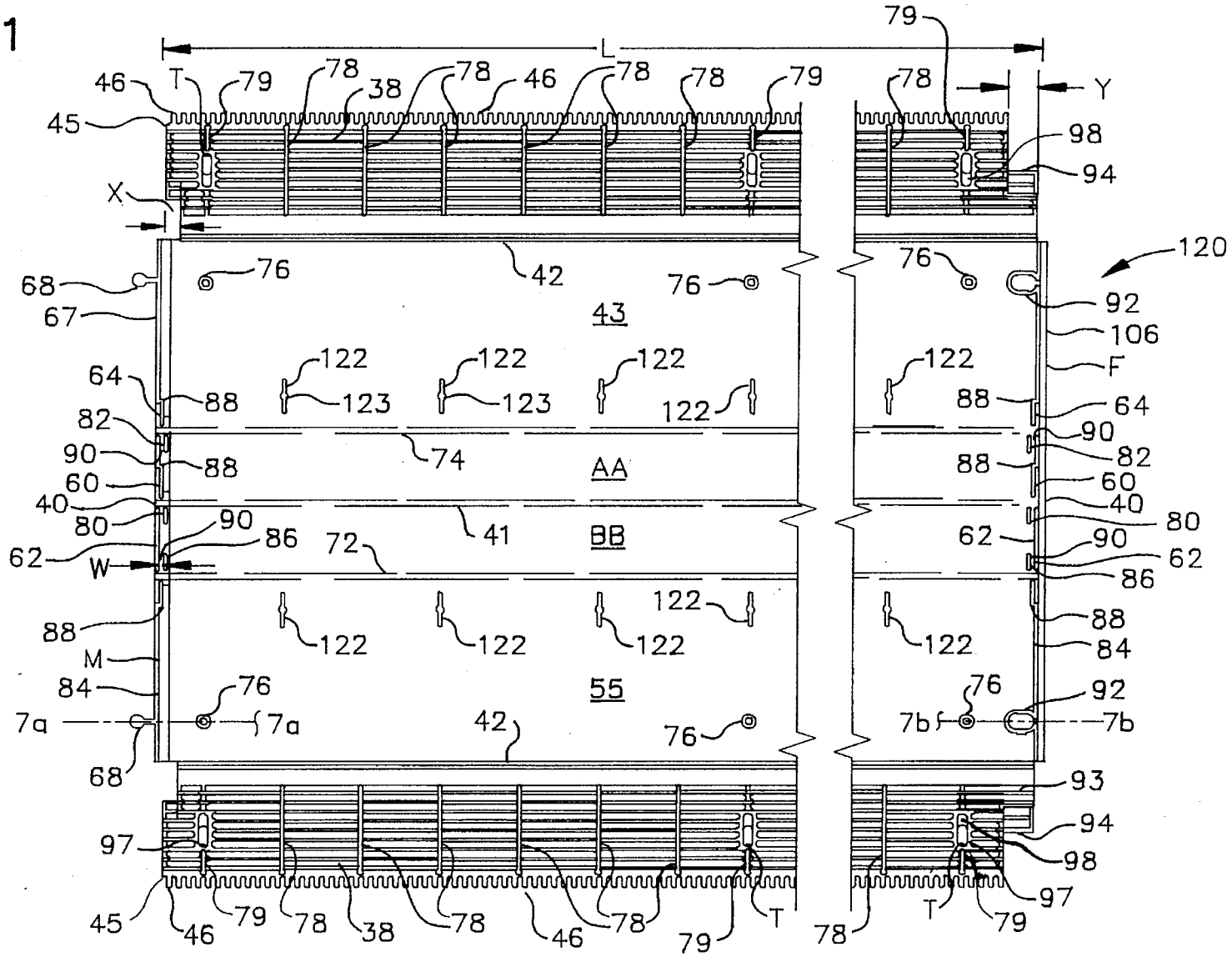
FIG. 11 is a bottom view (looking upward) of a second embodiment of a roof vent, showing the inner portions and the grille portions in a flat, spread apart relationship.

FIG. 11 shows the underside of vent 120 in the unfolded, spreadout, manufacturing position. Support posts 122 with their thickened central sections 123 are clearly visible. As the support wings 124 are under the grille, they are not seen in this FIG. 11, but may be seen in the top plan view of similar vent 130 depicted in FIG. 12.

Figure 12:
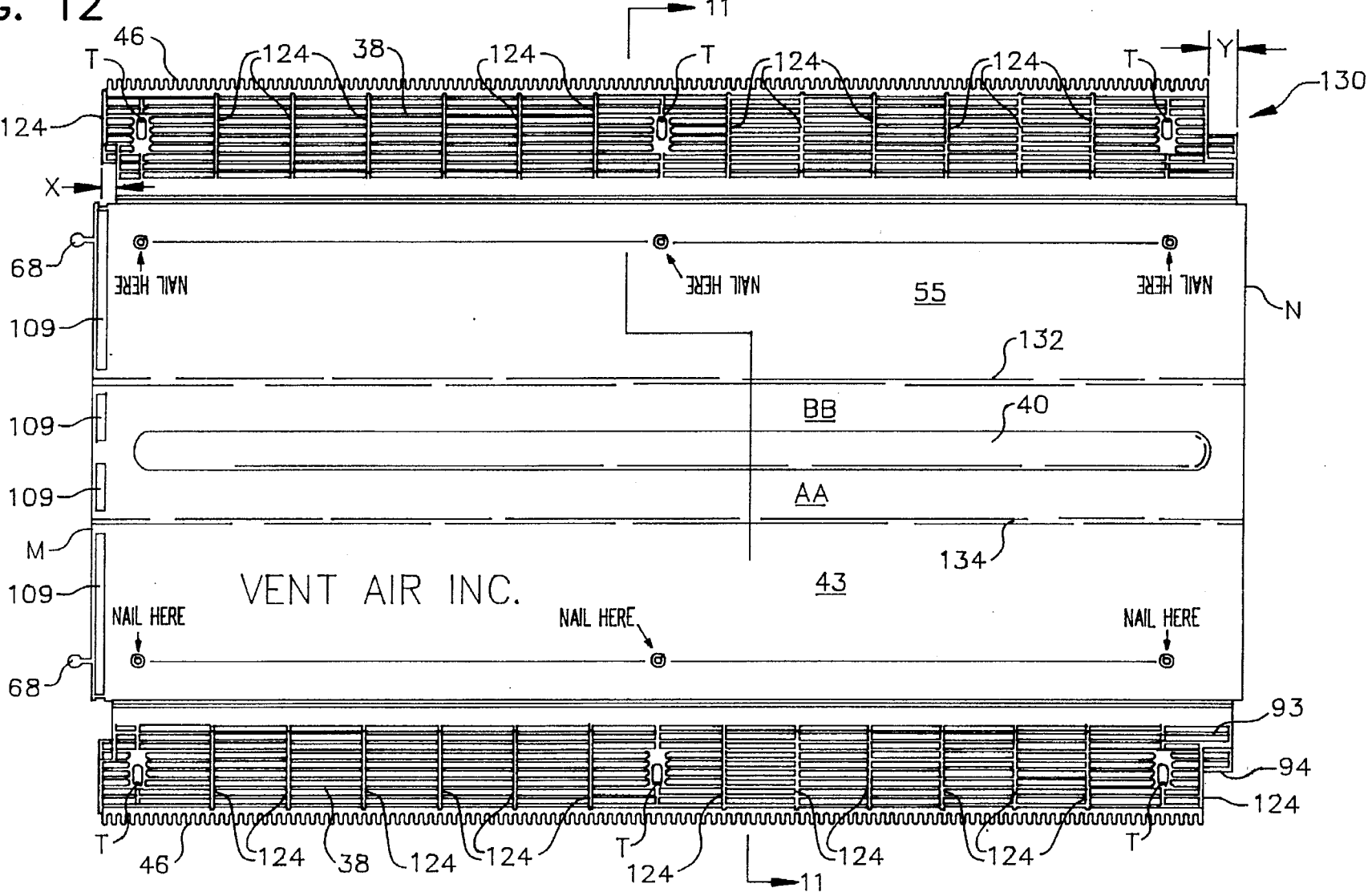
FIG. 12 is a top view (looking downward) of the second embodiment of a roof vent just illustrated in FIG. 11; this view is identical for the roof vent illustrated in FIG. 6 above.

A third embodiment vent 130 shown in FIG. 12 is similar to vent 120 shown in FIG. 11, but has been modified to show a neutral end N configuration; this type of end would normally be used at the end of a chain of vents (rather than to join it to an adjacent section) and is typically found at the edge of the roof.

Clearly seen running longitudinally at the center of the vent 130 is reinforcing portion 40. Laterally spaced apart from the reinforcing portion 40 are fold lines 132, corresponding to cutout portion 72 of similar vent 26 seen in FIG. 11. Likewise, reinforcing portion 134 corresponds to cutout portion 74 seen in the similar vent 26 in FIG. 11.

Vents 120 and 130 are preferably provided with wedge shaped stiffening supports 78 and support posts 79 as noted in the first embodiment vent 26 set forth above. Also, nail guides 76 fit through grille guide sidewalls 97 which define and opening through grille 38, all as more particularly described above.

Figure 13:
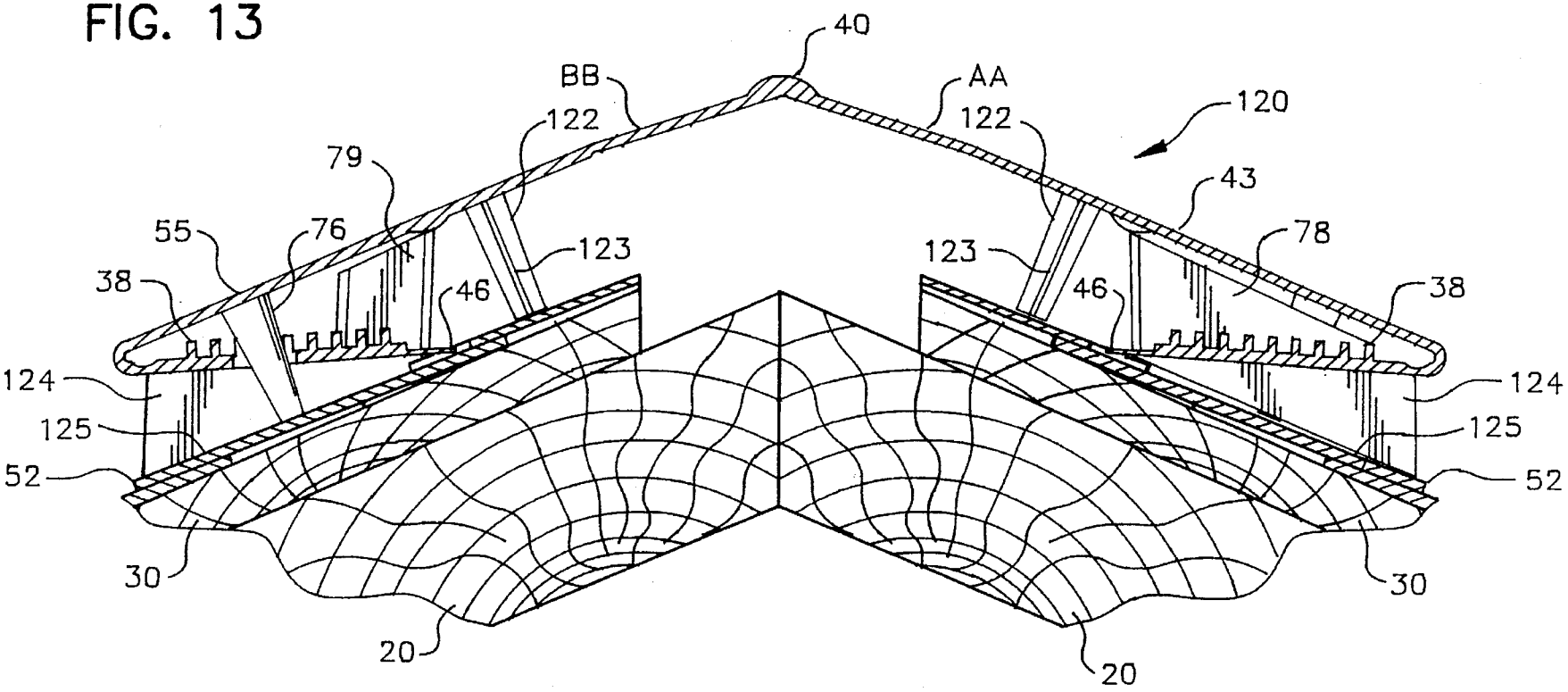
FIG. 13 is a vertical cross sectional view of the second embodiment of a roof vent, showing the vent in operation on a roof.

Turning now to FIG. 13, a cross-sectional view of vent 120 is provided. The cross-sectional view of vent 130 is similar. In this view, the position of stiffening supports 78 above grille 38 and below wall 44 is evident. Also, support wings 124 are seen provided below grille 38 in a position to support the wings above the roof shingle 52. In addition, support posts 122 are shown providing additional support to vent 120 to support it above the shingles 52.

Figure 14:
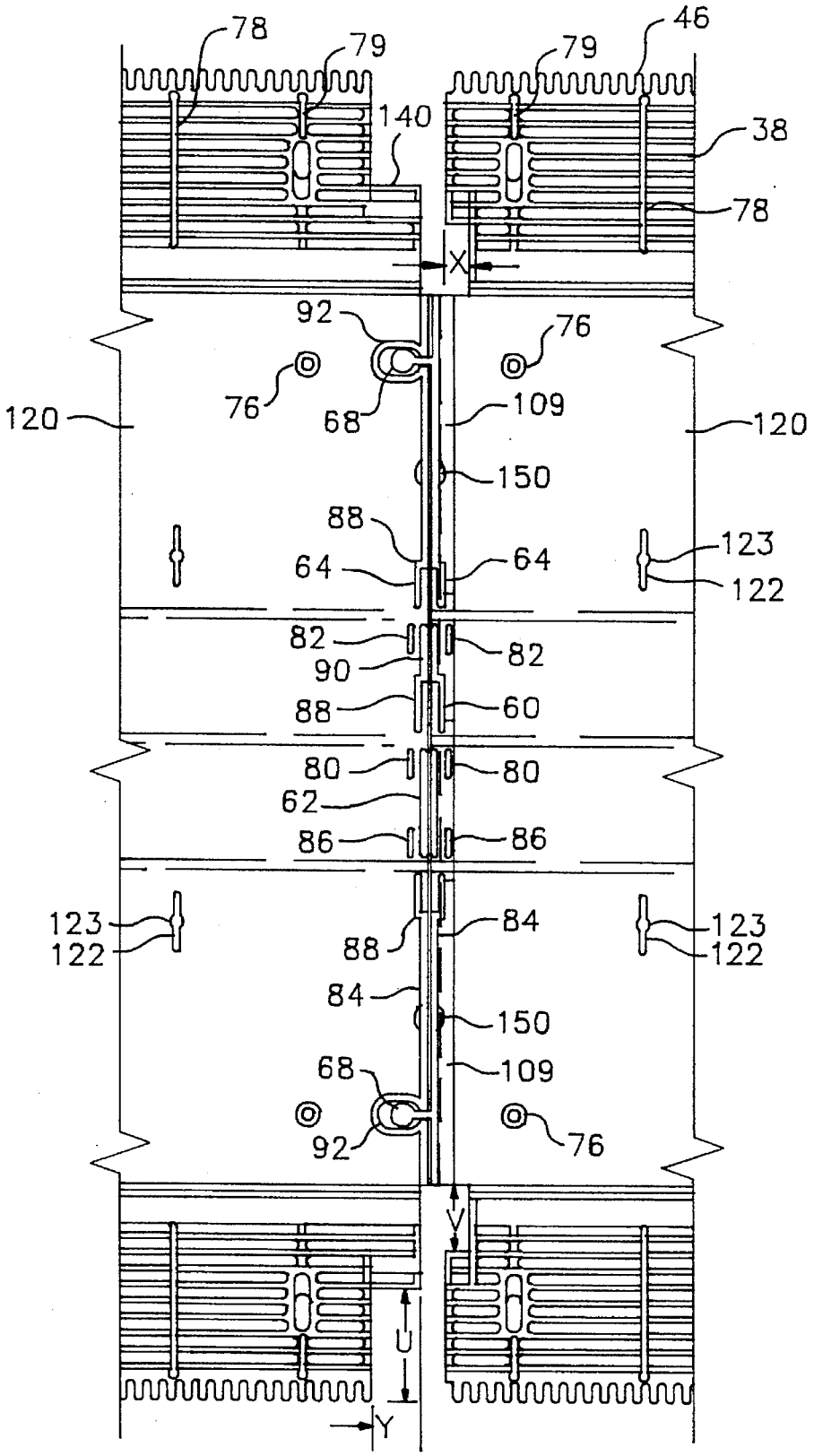
FIG. 14 is a bottom view (looking upward) of the second embodiment of a roof vent as illustrated in FIGS. 11 and 12 above, but showing how two adjacent roof panels are interlocked.

My interlocking mechanism provided for vents is illustrated in FIG. 14, which shows a bottom view (looking upward) of joined male M and female F ends of vent 120. Tabs 68 are shown affixed in receptacles 92. At the female end F, grille 38 is provided with an outwardly extending portion 140 of offset length Y and lateral width reduction U which allows the grille 38 to be folded inward yet avoid inteference with receptacles 92. At the male end M, the grille 38 is provided with an inset portion 142 of inward length X and lateral width reduction V. Inset portion 142 is sized to avoid inteference with gutter 109, which, as noted in FIG. 8 above, extends downward from underside wall 44 and laterally inward for a short distance.

Figure 15:
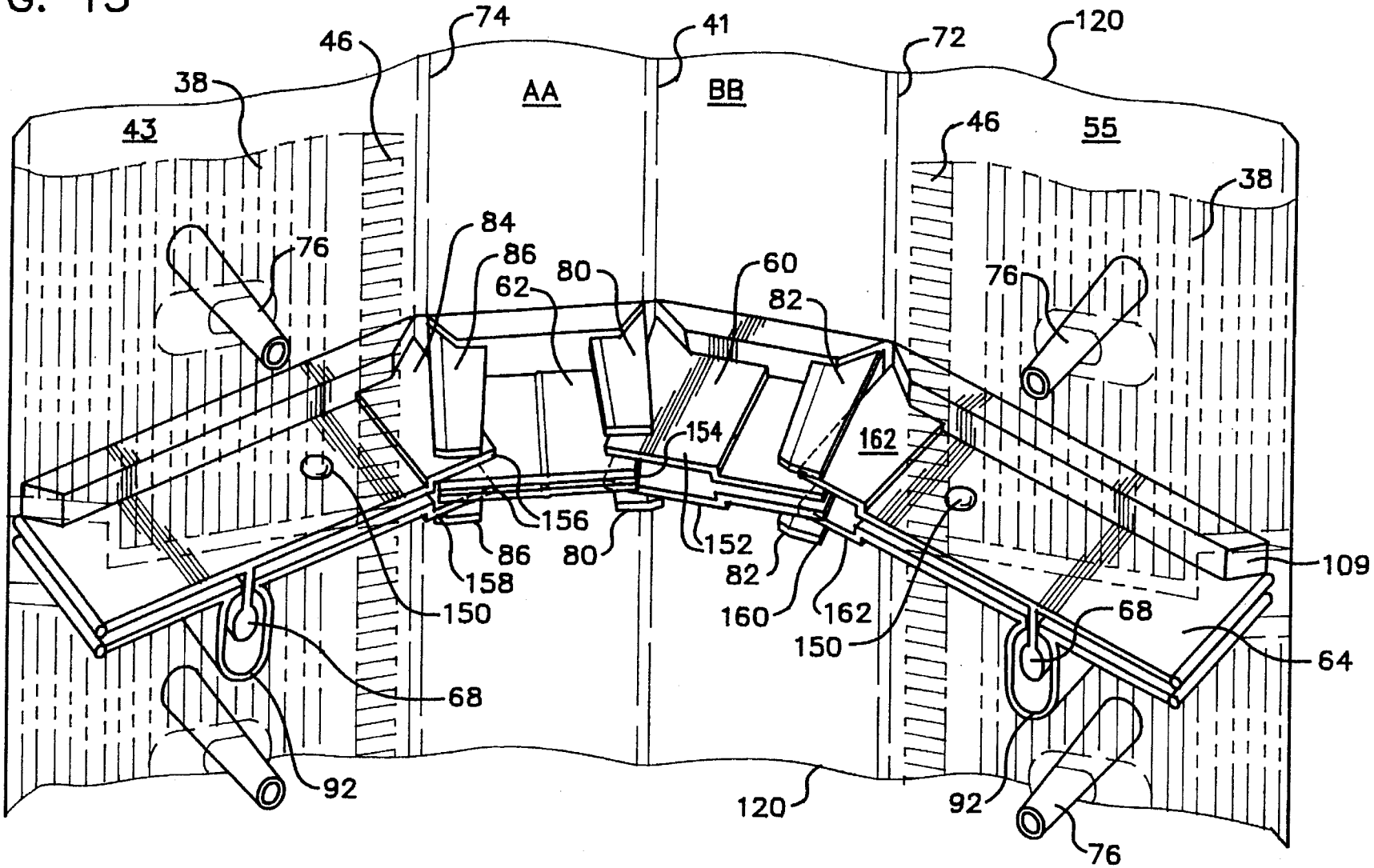
FIG. 15 is a perspective view, looking upward at a pair of roof vents, with the vents folded into their operational position, and showing where the vents have been permanently joined together for ease of installation of a long roof vent section.

Also shown in FIG. 14, as well as FIG. 15, are optional fasteners 150 such as rivets which can be used to join pairs of vents 150 in order to speed installation of the same. For example, a pair of two (2) foot length vents can be used together and joined to provide a four (4) foot roof vent.

In FIG. 15, the interlocking nature of the sidewall portions is shown in mirror image of the design shown in FIG. 14; clearly, the concept is reversable. In FIG. 15, it is clear that interfitting sidewall portion 62 fits between the spread apart walls 152 of sidewall 60 at the first end 154 of sidewall 62. Likewise, sidewall portion 62 fits between the spread apart walls 156 of sidewall 84 at the second end 158 of sidewall 62. The interior tab pairs 80 (at the first end 154 of sidewall 62) and the tab pairs 86 (at the second end 156 of sidewall 84) provide additional stability by slightly compressing walls 152 and 156, respectively, against sidewall 62. Similarly, a first end 160 of sidewall 60 fits between spread apart walls 162 of sidewall 64. Stability of that joint is provided by interior tabs 82.

Therefore, it is to be appreciated that the roof vent provided by way of the present invention is a significant improvement in the state of the art of ridge type roof vents. My vent is lightweight, being normally manufactured of polypropylene or polyethylene, and is capable of being easily packaged and shipped without taking up undue space.

It will be readily apparent to the reader that the present invention may be easily adapted to other embodiments incorporating the concepts taught herein and that the present figures are shown by way of example only and not in any way a limitation. Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

I claim:

1. A roof vent, the vent being of the type adapted for placement over an opening in the upper reaches of a roof, said roof of the type comprising shingles or membrane barrier outer surface, said vent comprising:

(a) a body, said body comprising (i) a first inner planar body panel, said panel integrally formed with and adjacent to (ii) a second inner planar body panel, and (iii) a first outer planar body panel, and (iv) a second outer planar body panel;

each of the aforementioned body panels extending longitudinally and laterally, and said first and said second inner planar body panels integrally formed with and laterally adjacent to each other, and said first outer planar body panel integrally formed with and laterally adjacent to said first inner planar body panel, and said second outer planar body panel integrally formed with and laterally adjacent to said second inner planar body panel, each of said body panels having an underside wall portion, (b) a first grille portion, said first grille portion extending laterally for a preselected width outward from said first outer planar body panel, said first grille portion joined to said first outer planar body at a first hinge, said first grille portion further comprising transverse, straight, stiffening supports extending vertically therefrom and laterally for at least a portion of said grille width, (c) a second grille portion, said second grille portion extending laterally for a preselected width outward from said second outer planar body panel, said second grille portion joined to said second outer planar body at a second hinge, said second grille portion further comprising transverse, straight, stiffening supports extending vertically and inwardly therefrom and laterally for at least a portion of said grille width, (d) wherein each of said first and second grille portions are adapted allow air to pass therethrough while inhibiting the passage of solids above a critical size therethrough, (e) and wherein each of said first and second grille portions are adapted to fold inwardly at said first and second hinges, respectively, so that said first and said second grille portions may be bent from an open, extended manufacturing position, to a permanent, operating position below said underside of said first and said second outer body panel portions.

2. The roof vent as set forth in claim 1, wherein said stiffening supports are generally triangular in shape, so as to snugly fit between said first grille portion and said first outer body panel and between said second grille portion and said second outer body panel when said roof vent is in its permanent, operating position.

3. The roof vent as set forth in claim 1 wherein said vent further comprises (a) a male end, and (b) a female end, and wherein said male end includes at least one tab, and wherein said female end includes a receptacle, and wherein said at least one tab and said receptacle cooperate to interlock, so that when a pair of said vents are placed adjacent one another by fitting said at least one tabs of a first vent into the receptacle of a second vent, the pair of vents may be joined together in a close fitting relationship.

4. The roof vent as set forth in claim 1, wherein said first outer planar body or said second outer planar body of said vent further comprises a nail guide, said nail guide being generally conical in shape with a annular central portion having a cylindrical inner wall defining central void suitable for receiving a nail therethrough.

5. The roof vent as set forth in claim 4, wherein said nail guide is of sufficient structural strength to support said vent against compression thereof against a roof.

6. The roof vent as set forth in claim 1 wherein said first and second grille portions each further include a void defining structure adapted to receive therethrough said nail guide.

7. The roof vent as set forth in claim 6, wherein said void defining structure in said first grille portion or in said second grille portion further comprises a solid space filling portion, so that said void defining structure is adapted to snugly fit against said nail guide.

8. The roof vent as set forth in claim 6, wherein said void defining structure in said first grille portion or in said second grille portion further includes a tip, said tip adapted to frictionally engage said nail guide when said first or said second grille portions are folded inward into an operational position.

9. The roof vent as set forth in claim 1 wherein said first and said second grille portions each further comprise a distal end, and affixed at each of said distal ends a set of flexible teeth, said teeth extending laterally from said grille portions and adapted to compress downward toward gaps between shingles, and to a close fitting relationship with shingles, so as to form a barrier against intrusion of solid matter between said shingles and said grille.

10. The roof vent as set forth in claim 1, wherein said first and said second grille portions each further comprise a set of transverse support wings, said support wings extending vertically and outwardly from each of said first and said second grille portions and laterally for at least a portion of the width of each of said first and said second grille portions, said support wings further comprising a foot portion adapted to set on said roof, so as to support each of said first and said second grille portions above said roof a predetermined distance as fixed by the dimensions of said support wings.

11. The roof vent as set forth in claim 1, wherein said vent further comprises a neutral end, said neutral end adapted to be placed at the end of a series of vents on said roof.

12. The roof vent as set forth in claim 1, wherein said roof vent further comprises sidewall supports of height E adjacent to at least one end of said vent.

13. The roof vent as set forth in claim 12, wherein said stiffening supports comprise wedge shaped supports extending from each of said first and said second grille portions, and wherein said wedge shaped supports are of height H, and wherein said height H is less than or equal to height E.

14. The roof vent as set forth in claim 13, wherein said height H of said wedge shaped supports is slightly less than height E of said sidewall supports.

15. The roof vent as set forth in claim 1, wherein each of said first and said second grille portions further comprise one or more support wings, said support wings extending vertically downward below each of said first and said second grille portions to rest upon at least a portion of said roof.

16. The roof vent as set forth in claim 15, wherein said support wings are generally triangular in shape.

17. The roof vent as set forth in claim 15, wherein said support wings are integrally molded to each of said first and said second grille portions.

18. The roof vent as set forth in claim 1, further comprising (a) support wings extending from each of said first and said second grille portions, and (b) wherein said stiffening supports are wedge shaped and extend from each of said first and said second grille portions, and (c) wherein said support wings are aligned with, and comprise lower extensions of, said wedge shaped supports.

19. The roof vent as set forth in claim 18, wherein said support wings and said wedge shaped supports are integrally molded in a monolithic roof vent structure.

20. The roof vent as set forth in claim 18, further comprising a reinforcing portion running longitudinally along said vent to join said first inner planar body panel and said second inner planar body panel.

21. The roof vent as set forth in claim 3, wherein at said female end, an overhanging roof is provided, and at said male end, a gutter is provided below said overhanging roof, and wherein said overhanging roof and said gutter cooperate to reduce the ability of moisture to escape through the joint which is formed between said female end and said male end of said pair of roof vents.

* * * * *

UNITED STATES PATENT AND TRADEMARK OFFICE

CERTIFICATE OF CORRECTION

PATENT NO. : 5,457,920

DATED : October 17, 1995

INVENTOR(S) : Walts, David A.

It is certified that error appears in the above-identified patent and that said Letters Patent is hereby corrected as shown below:

In column 6, line 65, delete "hels" and insert --helps--.

Signed and Sealed this

Twenty-fifth Day of March, 1997

*Attest:*

Bruce Lehman

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,457,920

DATED : October 17, 1995

INVENTOR(S) : Waltz, David A.

It is certified that error appears in the above-identified patent and that said Letters Patent is hereby corrected as shown below:

In the Abstract, line 2, delete "grillee" and insert --grille--.

In column 3, line 36, after "FIG. 4 is" insert --a--.

In column 3, line 53, after "cooperate" delete "to".

In column 5, line 63, after "84," insert --as--.

In column 6, line 17, after "toward" delete "in".

In column 6, line 54, delete "recepticles" and insert --receptacles--.

In column 6, line 57, delete "interfetting" and insert --interfitting--.

In column 7, line 11, after "entry 99" delete "is".

In column 7, line 33, delete "overhangings" and insert --overhanging--.

In column 8, line 31, delete "and opening" and insert --an opening--.

UNITED STATES PATENT AND TRADEMARK OFFICE

CERTIFICATE OF CORRECTION

PATENT NO. : 5,457,920

DATED : October 17, 1995

INVENTOR(S) : Walts, David A.

It is certified that error appears in the above-identified patent and that said Letters Patent is hereby corrected as shown below:

In column 9, line 63, after "are adapted" insert --to--.

In column 10, line 24, delete "with a" and insert --with an--.

In column 10, line 25, after "wall defining" insert --a--.

Signed and Sealed this

Tenth Day of June, 1997

*Attest:*

Bruce Lehman

BRUCE LEHMAN

*Attesting Officer*

*Commissioner of Patents and Trademarks*